US008701906B1

(12) United States Patent
Anderson

(10) Patent No.: US 8,701,906 B1
(45) Date of Patent: Apr. 22, 2014

(54) INGREDIENT DISPENSING CAP FOR MIXING BEVERAGES WITH PUSH-PULL DRINKING SPOUT

(71) Applicant: Michael R. Anderson, Deerfield Beach, FL (US)

(72) Inventor: Michael R. Anderson, Deerfield Beach, FL (US)

(73) Assignee: Blast Max LLC, Reno, NV (US)

( * ) Notice: Subject to any disclaimer, the term of this patent is extended or adjusted under 35 U.S.C. 154(b) by 0 days.

(21) Appl. No.: 13/849,010

(22) Filed: Mar. 22, 2013

Related U.S. Application Data

(63) Continuation of application No. 13/030,407, filed on Feb. 18, 2011, now abandoned, which is a continuation-in-part of application No. 12/649,438, filed on Dec. 30, 2009, now Pat. No. 8,297,456.

(60) Provisional application No. 61/141,682, filed on Dec. 31, 2008.

(51) Int. Cl.
*B65D 41/20* (2006.01)
*B65D 51/22* (2006.01)
*B65D 17/44* (2006.01)

(52) U.S. Cl.
USPC ..... 215/227; 215/228; 215/251; 215/257; 215/297; 215/301; 215/DIG. 8; 206/220; 206/222; 220/212; 220/258.4; 220/277; 220/278

(58) Field of Classification Search
USPC ..... 206/219–222; 215/227, 228, 249, 251, 215/257, 297, 301, 305, DIG. 8; 220/212, 220/258.3–258.5, 262, 264, 277, 278; 222/519, 521, 522, 80, 83.5, 83, 88
See application file for complete search history.

(56) References Cited

U.S. PATENT DOCUMENTS

| | | | | |
|---|---|---|---|---|
| 2,445,395 | A | 7/1948 | Greene et al. | |
| 2,653,610 | A | 9/1953 | Smith | |
| 2,659,370 | A | 11/1953 | Smith | |
| 2,721,552 | A | 10/1955 | Nosik | |
| 3,156,369 | A | 11/1964 | Bowes et al. | |
| 3,167,217 | A | 1/1965 | Corsette et al. | |
| 3,221,917 | A | 12/1965 | De Santo et al. | |
| 3,347,410 | A | 10/1967 | Schwartzman | |
| 3,430,795 | A | 3/1969 | Laufer | |
| 3,443,713 | A | 5/1969 | Kosar | |
| 3,548,562 | A | 12/1970 | Schwartzman | |
| 3,603,484 | A * | 9/1971 | Ogle | 222/94 |

(Continued)

FOREIGN PATENT DOCUMENTS

JP 08198285 A * 8/1996

*Primary Examiner* — J. Gregory Pickett
*Assistant Examiner* — Ned A Walker
(74) *Attorney, Agent, or Firm* — Malin Haley DiMaggio & Bowen, P.A.

(57) ABSTRACT

A dispensing cap for storing one or more ingredients in the cap body until the time of use. The stored ingredients in the cap are dispensed manually into a primary container for mixing. The dispensing cap includes a push-pull, flow-through drinking spout with a fluid valve for opening and closing the fluid flow from the primary container. The dispensing cap body includes several elements all of which are formed in a single molded cap body. The storage chamber of the dispensing cap includes a foil seal that can be partially opened by an activating member manually connected to the drinking spout for dispensing the ingredients into the primary container. The cap body is threadably attached to a primary container threaded neck.

6 Claims, 9 Drawing Sheets

(56) References Cited

U.S. PATENT DOCUMENTS

| | | | | | |
|---|---|---|---|---|---|
| 3,768,697 | A | | 10/1973 | Lerner | |
| 3,802,604 | A | | 4/1974 | Morane et al. | |
| 3,924,741 | A | | 12/1975 | Kachur et al. | |
| 4,024,952 | A | | 5/1977 | Leitz | |
| 4,073,406 | A | | 2/1978 | Goncalves | |
| 4,247,001 | A | | 1/1981 | Wiegner | |
| 4,465,183 | A | | 8/1984 | Saito et al. | |
| 4,723,687 | A | * | 2/1988 | Kutterer | 222/83 |
| 4,785,931 | A | * | 11/1988 | Weir et al. | 206/222 |
| 4,798,287 | A | | 1/1989 | Groves et al. | |
| 4,821,875 | A | | 4/1989 | Groves et al. | |
| 4,832,214 | A | | 5/1989 | Schrader et al. | |
| 4,903,865 | A | | 2/1990 | Janowitz | |
| 4,982,875 | A | | 1/1991 | Pozzi et al. | |
| 5,027,872 | A | | 7/1991 | Taylor et al. | |
| 5,038,951 | A | | 8/1991 | Rizzardi | |
| 5,088,627 | A | | 2/1992 | Musel | |
| 5,255,812 | A | | 10/1993 | Hsu | |
| 5,352,196 | A | | 10/1994 | Haber et al. | |
| 5,370,222 | A | | 12/1994 | Steigerwald et al. | |
| 5,482,172 | A | | 1/1996 | Braddock | |
| 5,598,951 | A | | 2/1997 | DeBano, Jr. | |
| 5,782,345 | A | | 7/1998 | Guasch et al. | |
| 5,794,802 | A | | 8/1998 | Caola | |
| 5,839,573 | A | | 11/1998 | Morini | |
| 5,863,126 | A | | 1/1999 | Guild | |
| 5,884,759 | A | | 3/1999 | Gueret | |
| 5,950,819 | A | | 9/1999 | Sellars | |
| 6,003,728 | A | | 12/1999 | Elliott | |
| 6,098,795 | A | | 8/2000 | Mollstam et al. | |
| 6,116,445 | A | | 9/2000 | Ikemori et al. | |
| 6,148,996 | A | | 11/2000 | Morini | |
| 6,230,884 | B1 | | 5/2001 | Coory | |
| 6,257,463 | B1 | | 7/2001 | De Polo | |
| 6,364,103 | B1 | | 4/2002 | Sergio et al. | |
| 6,372,270 | B1 | | 4/2002 | Denny | |
| 6,412,659 | B1 | | 7/2002 | Kneer | |
| 6,435,341 | B1 | | 8/2002 | Nobbio | |
| 6,450,367 | B1 | | 9/2002 | Sittler | |
| 6,477,743 | B1 | | 11/2002 | Gross et al. | |
| 6,513,650 | B2 | | 2/2003 | Mollstam et al. | |
| RE38,067 | E | | 4/2003 | Gueret | |
| 6,571,994 | B1 | | 6/2003 | Adams et al. | |
| 6,609,634 | B2 | | 8/2003 | De Laforcade et al. | |
| 6,644,471 | B1 | | 11/2003 | Anderson | |
| 6,679,375 | B1 | | 1/2004 | Coory | |
| 6,763,939 | B2 | | 7/2004 | Alticosalian | |
| 6,772,910 | B1 | | 8/2004 | Coory | |
| 6,854,595 | B2 | | 2/2005 | Kiser | |
| 6,874,661 | B2 | | 4/2005 | Timmerman et al. | |
| 6,908,011 | B2 | | 6/2005 | Cho | |
| 6,921,087 | B2 | | 7/2005 | Takahashi et al. | |
| 6,926,138 | B1 | | 8/2005 | Basham et al. | |
| 7,055,685 | B1 | | 6/2006 | Patterson et al. | |
| 7,175,049 | B2 | | 2/2007 | Kastenschmidt et al. | |
| 7,249,690 | B2 | | 7/2007 | Smith et al. | |
| 7,252,091 | B1 | | 8/2007 | Wayne et al. | |
| 7,261,226 | B2 | | 8/2007 | Adams et al. | |
| 7,303,328 | B2 | * | 12/2007 | Faraldi et al. | 366/101 |
| 7,325,676 | B2 | | 2/2008 | Galaz Rodriguez | |
| 7,377,383 | B2 | | 5/2008 | Henry | |
| 7,464,811 | B2 | | 12/2008 | Patterson et al. | |
| 7,503,453 | B2 | | 3/2009 | Cronin et al. | |
| 7,562,782 | B2 | | 7/2009 | Yorita | |
| 7,568,576 | B2 | | 8/2009 | Sweeney, Jr. et al. | |
| 7,614,513 | B2 | | 11/2009 | Anderson | |
| 7,854,104 | B2 | | 12/2010 | Cronin et al. | |
| 7,874,420 | B2 | | 1/2011 | Coon | |
| 7,886,922 | B2 | | 2/2011 | Seelhofer | |
| 7,900,787 | B2 | | 3/2011 | Oh et al. | |
| 7,951,109 | B2 | | 5/2011 | Anderson | |
| 8,083,055 | B2 | | 12/2011 | Simonian et al. | |
| 8,141,700 | B2 | | 3/2012 | Simonian et al. | |
| 8,215,481 | B1 | | 7/2012 | Knickerbocker | |
| 2002/0040856 | A1 | | 4/2002 | Mollstam et al. | |
| 2003/0072850 | A1 | | 4/2003 | Burniski | |
| 2004/0020797 | A1 | | 2/2004 | Fontana | |
| 2004/0112770 | A1 | | 6/2004 | Oswald | |
| 2004/0188465 | A1 | | 9/2004 | Timmerman et al. | |
| 2004/0200740 | A1 | | 10/2004 | Cho | |
| 2004/0200741 | A1 | | 10/2004 | Cho | |
| 2005/0115845 | A1 | | 6/2005 | Cho | |
| 2005/0161348 | A1 | | 7/2005 | Morini | |
| 2005/0236424 | A1 | | 10/2005 | Walters et al. | |
| 2006/0006077 | A1 | | 1/2006 | Mosher et al. | |
| 2006/0081646 | A1 | * | 4/2006 | Rho | 222/80 |
| 2006/0118435 | A1 | | 6/2006 | Cronin et al. | |
| 2007/0051689 | A1 | | 3/2007 | Anderson | |
| 2008/0125704 | A1 | | 5/2008 | Anderson | |
| 2008/0202950 | A1 | | 8/2008 | Anderson | |
| 2009/0020494 | A1 | | 1/2009 | Seelhofer | |
| 2009/0308831 | A1 | | 12/2009 | Anderson | |
| 2010/0000960 | A1 | | 1/2010 | Anderson | |
| 2010/0200437 | A1 | | 8/2010 | Coon | |
| 2011/0290677 | A1 | | 12/2011 | Simonian et al. | |
| 2011/0290678 | A1 | | 12/2011 | Simonian et al. | |

* cited by examiner

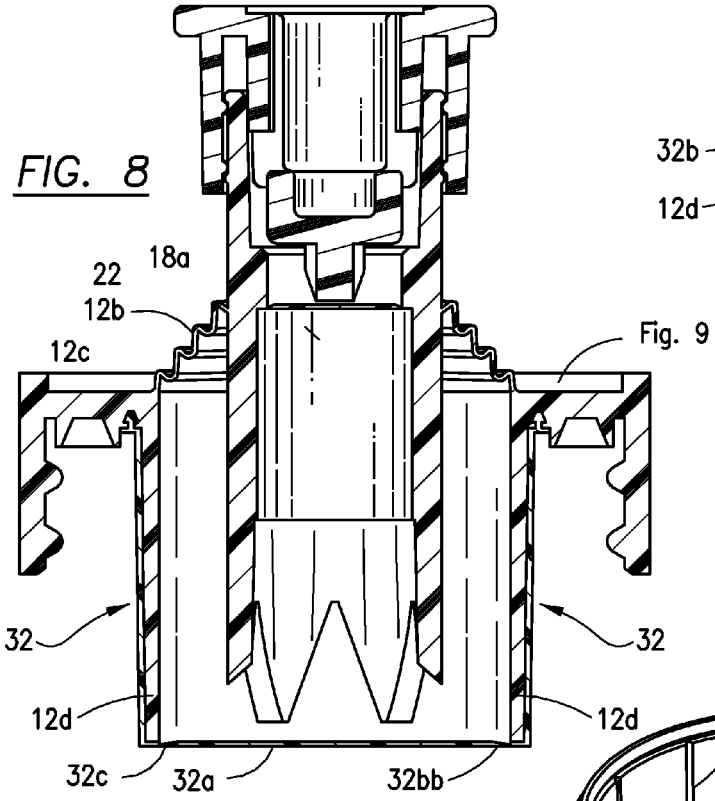
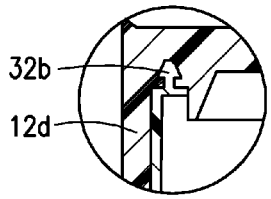
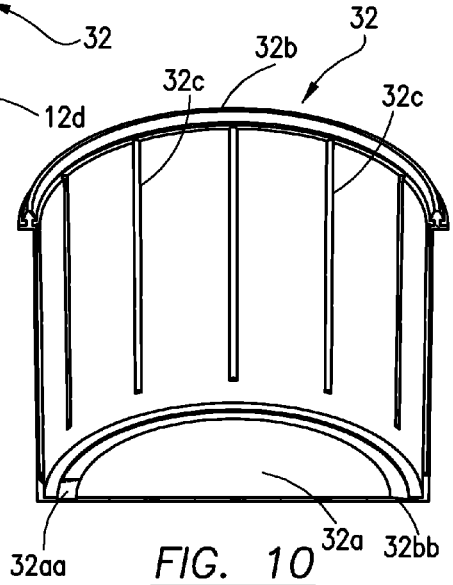
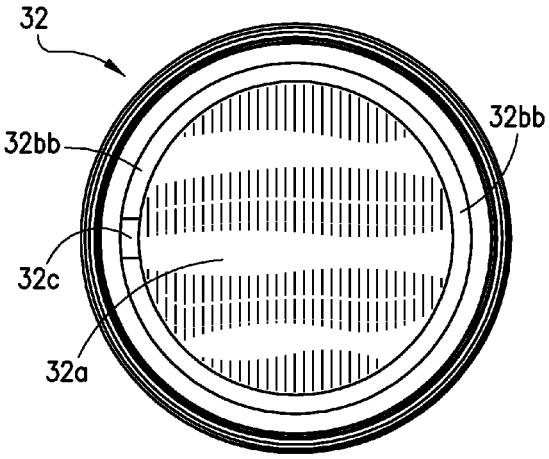
FIG. 11

INGREDIENT DISPENSING CAP FOR MIXING BEVERAGES WITH PUSH-PULL DRINKING SPOUT

CROSS REFERENCE TO RELATED APPLICATIONS

This application is a continuation of co-pending U.S. patent application Ser. No. 13/030,407 filed on Feb. 18, 2011, which is a continuation-in-part of U.S. patent application Ser. No. 12/649,438 filed on Dec. 30, 2009, now U.S. Pat. No. 8,297,456 issued Oct. 30, 2012, which claims priority to U.S. Provisional Patent Application No. 61/141,682, filed Dec. 31, 2008.

BACKGROUND OF THE INVENTION

1. Field of the Invention

This invention relates to an ingredient dispensing cap that is mounted on a primary container for storing ingredients to be dispensed into the primary container contents at time of use, and specifically to a dispensing cap having an ingredient storage chamber and a push-pull drink spout (with a drink through passage) that is used to dispense the stored ingredients.

2. Description of Related Art

Many beverages, cleaning products, oil products, pharmaceuticals, and other chemicals and substances, do not retain their stability, strength, and effectiveness, for long after the ingredients have been mixed in a solution or suspension with a different liquid or substance. Many liquids, gels, or acquiesce type solutions are formulated for shelf life rather than for quality, effectiveness, and potency of a product. In many cases, ingredients such as: stabilizers, fillers, preservatives, binders, and other types of chemicals and substances are added that now can be reduced or eliminated by this invention. This reduced shelf life after mixing mandates that the mixed product be utilized relatively soon after mixing to obtain full strength and effectiveness, to prevent loss of effective strength, deterioration, discoloration, interactions between ingredients and reduced effectiveness. Also it is estimated that 60 billion empty bottles go into landfills in the United States every year. A liquid dosing cap with concentrate can be used to allow a consumer to use a reusable bottle, reducing the problem of empty bottles in landfills.

A dispensing cap can be used for any primary container to store different ingredients to be mixed in the primary container. The dispensing cap includes its own ingredient storage and release chamber. Any ingredients that are stored in the dispensing cap can be dispensed into any container (whether threaded, snapped or adhered to any type of primary container) for mixing with the container contents manually by an individual when ready for use. The shelf life of the combined ingredients in this invention can be extended indefinitely. The dispensing cap can be used as a storage chamber of one or more storage tanks in a dosing cap to release a combination of liquids and or powders for any ingredients that can be admixed with any other contents that are stored in a primary container.

Many current bottle caps include a drinking spout and flow valve to allow the user to drink directly from the primary container. Water bottles are good example that includes caps with drinking spouts. The invention disclosed herein provides for a dispensing cap that includes a drink through drinking spout and liquid or semi liquid flow valve that is also used to activate the ingredient dispensing into the primary container.

Applicants' U.S. Pat. No. 6,644,471, issued Nov. 11, 2003, describes a dispensing capsule that permits drinking through the dispensing capsule. Applicants' pending patent application, U.S. Ser. No. 12/649,438, filed Dec. 30, 2009, describes a drinkable storage and dispensing ingredient cap.

BRIEF SUMMARY OF THE INVENTION

A dispensing cap with one or more chambers combined for storing and releasing one or more ingredients into a primary container. The dispensing cap includes a drinking spout. The dispensing cap body includes an ingredient storage chamber having a bottom wall made of a foil seal and/or plastic wall with a line of weakening or a tearable molded plastic seal barrier. The dispensing cap body also includes a threaded or other means of attaching area that can be placed in, over, on top, or around a container opening or attached to a bottle neck or any other primary container. A cylindrical shaped or any shape depending on the container dispensing activating member is disposed inside said dispensing cap body ingredient chamber. The dispensing activating member includes a cutting edge along its bottom perimeter. A sealable dust cover is attachable to the cap body top for preventing inadvertent activation to the activating member when in storage or not in use. The dust cover can be removed manually.

The drinking spout is depressed for dispensing; the dispensing cap body provides an activating member and drinking spout and a manual valve that is spill proof and operates by push-pull as part of the activating member to be able to have a flow through the drinking spout after the ingredients are dispensed.

It is an object of this invention to provide a substance or ingredient release dispensing cap for dispensing one or more ingredients into a primary container contents at time of use for mixing to eliminate shelf life problems and the use of preservatives and with a drink through drinking spout.

It is another object of this invention to provide a dispensing cap that is activated using a push-pull dispensing activator and drinking spout that allows the user to mix the stored ingredients with the contents of the primary container and to drink the contents through the dispensing cap.

It is yet another object of this invention to provide a dispensing cap for dispensing ingredients into a primary container that includes a drinking liquid flow valve that can allow or stop the flow through the dispensing cap.

And yet another object is to manufacture a dosing cap that the body and workings of a dose cap can be molded in one piece and other elements can be attached.

In accordance with the use and other objects which will become apparent hereinafter, the present invention will now be described with particular reference to the accompanying drawings.

BRIEF DESCRIPTION OF THE DRAWINGS

FIG. 8 shows a side elevational view in cross section of an alternate embodiment of the invention.

FIG. 9 shows a partial view, cut away of the fastener shown in FIG. 8 in a side elevational cross-sectional view.

FIG. 10 shows a top perspective view of a ceiling cup showing the midsection in cross-section.

FIG. 11 shows a top plan view of the ceiling cup shown in FIG. 10.

DETAILED DESCRIPTION OF THE INVENTION

Figure 1:
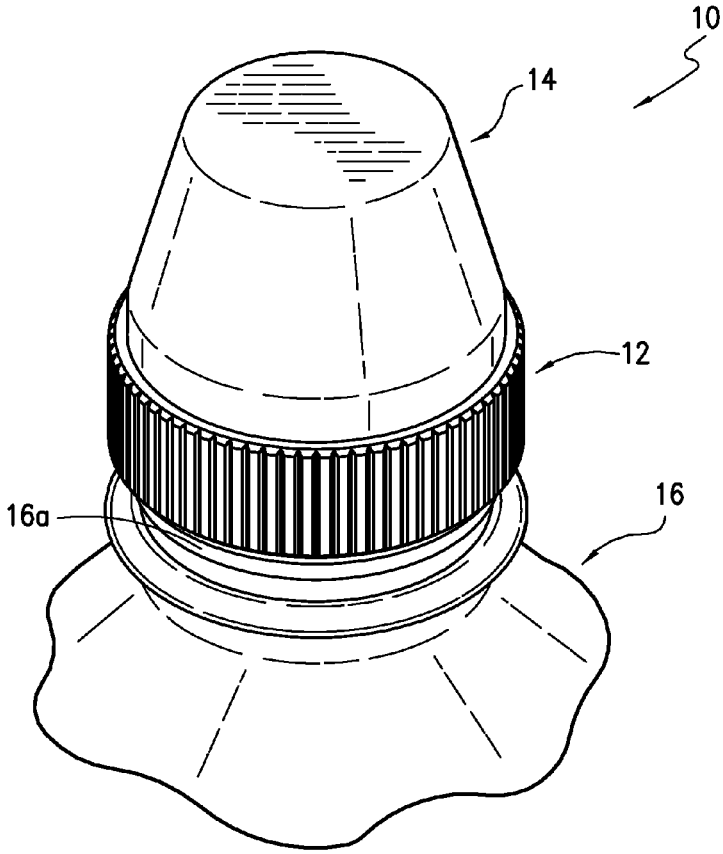
FIG. 1 shows a perspective view of the invention with the dust cover attached.

Referring now to the drawings and in particular FIG. 1, the present invention is shown at 10 including a cap body 12 to which a dust cover 14 is attached. The cap body 12 is attached to a primary container 16. The container neck threads 16*a* are partially shown.

The primary container 16 can be a bottle or other type of container that houses an ingredient such as a liquid. The cap body 12 contains one or more ingredients that upon activation will be dispensed into the contents of primary container 16 at time of use. After the cap body dispensing has been activated, the cap body also has a drinking spout and valve to allow the user to drink directly from the primary container 16 through the cap body 12. The user can also close the drinking valve after the cap body 12 has been activated to prevent liquid form spilling out of container 16.

Figure 2:
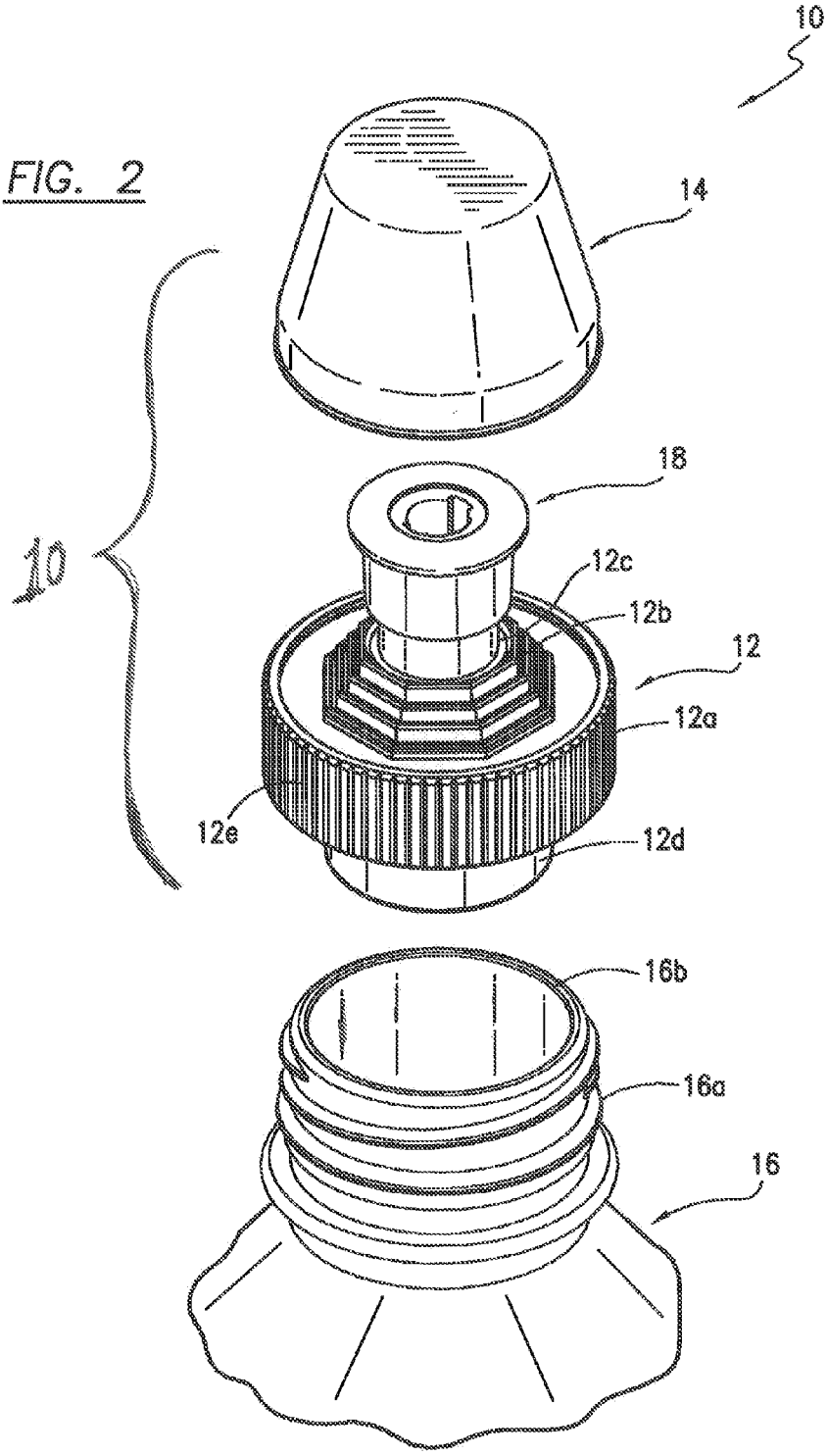
FIG. 2 shows a perspective exploded view of the invention.

Referring now to FIG. 2, the invention is shown at 10 comprising dispensing cap 12 and dust cover 14. The dispensing cap 12 includes fastening threads or any kind of attachment which allows the cap 12 to be threadably fastened to primary container 16 over container opening 16*b* and attachable to primary container threads 16*a*. The dispensing cap 12 includes a push-pull drinking spout 18 that also includes an open/close liquid flow valve 18*aa* that can be manually positioned by the user. Once the ingredients in the dispensing cap 12 have been activated, the user can drink directly from the primary container 16 through cap 12 and drinking spout 18. The dispensing cap 12 includes a cap body for storing ingredients that includes activating member 12*c* and resilient octagonal wall 12*b* that connects the activating member 12*c* to the ingredient storage chamber 24 formed by cylinder 12*d*. The cap body includes a cap cylindrical wall 12*a* that is used to manually twist the cap 12 on or off the primary container 16. The dust cover 14 is removed before use.

Figure 3:
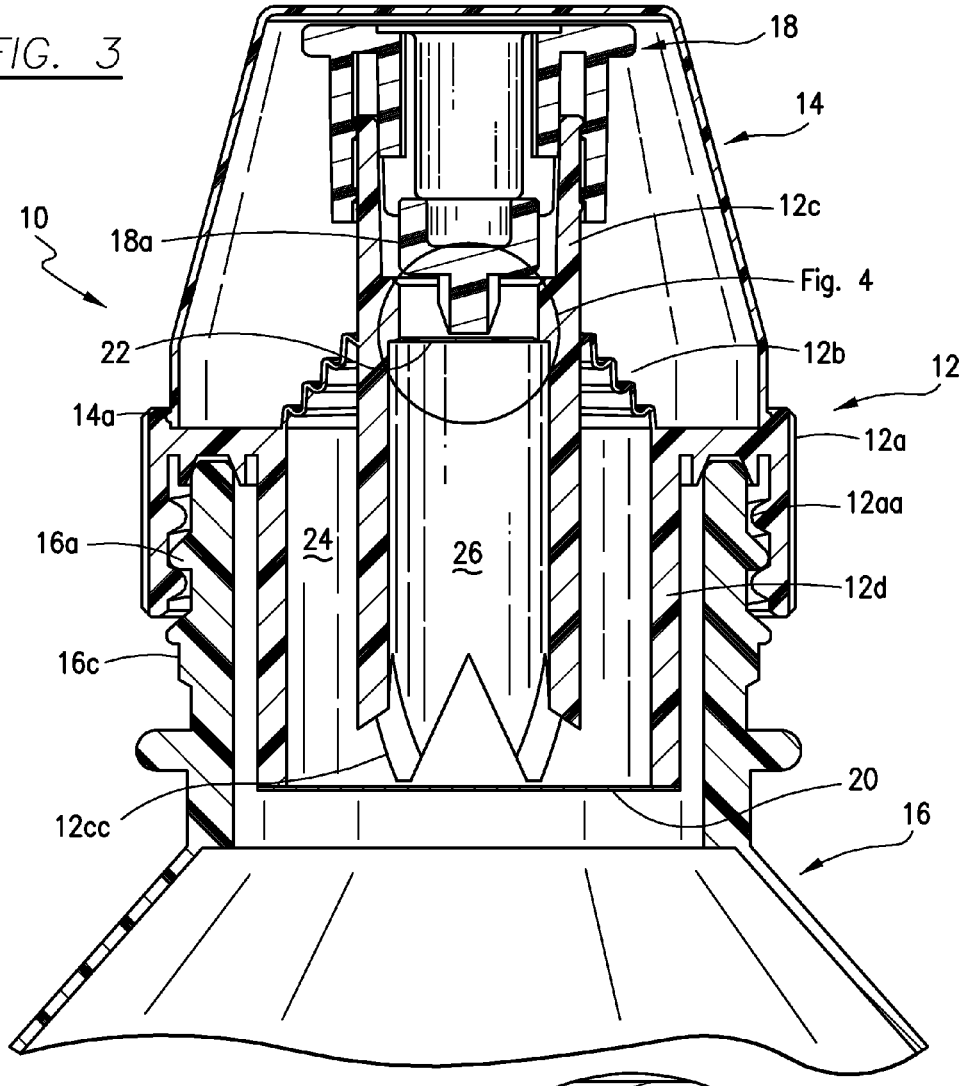
FIG. 3 shows a side elevational view in cross section of the present invention with the dust cover attached.

Referring now to FIG. 3, the invention 10 is shown in cross-section. An important feature of the dispensing cap is the use of two seals to encapsulate the ingredients stored in the dispensing cap before use. The ingredients are protected by the two seals (upper and lower) from moisture and the ambient environment until the time of use when both seals are ruptured. FIG. 3 shows both the upper seal 22, which is a molded plastic liquid barrier, and lower aluminum foil seal 20 intact and/or a line of weakening.

The aluminum foil seal 20 may be attached to the cylinder 12*d* by electromagnetic (RF) energy that heats the foil or any other means of attaching. A plastic barrier could be attached by ultrasonic welding in lieu of a foil seal or in combination thereof 20 or a molded plastic barrier could be used with a line of weakening.

The dust cover 14 is shown as a snap in-place using an annular lip 14*a* that snaps into a recess in the body 12*a* top edge. The dust cover 14 prevents the dispensing cap 12 from being accidentally activated until the dust cover is removed because of the rigidity of the dust cover 14 and to help eliminate any contaminates to adhere to the drinking spout during storage. The dispensing activating member 12*c* is shielded from contact when the dust cover 14 is in place. Therefore, the dust cover 14 is a very important element of the present invention to prevent the dispensing cap from being activated accidentally before the time of use.

The dispensing cap 12 has an annular cylindrical wall 12*a* that includes fastening threads or other means 12*aa* disposed on the inside surface of the annular wall 12*a* which are used to fasten the dispensing cap 12 to a primary container neck 16*c* that also has fastening threads 16*a*. The dispensing cap wall 12*a* is integrally constructed with an ingredient storage chamber 24 formed by cylinder 12*d* and are molded as one piece. A thin octagonally-shaped flexible wall 12*b* is connected at its base to cylinder 12*d* and at its top to dispensing activating member 12*c*. The thin octagonally shaped flexible wall 12*b* has flat segments forming a stair step array for up and down movement. The flexible wall 12*b* could be rectangular or hexagonal in shape. The activating member 12*c* encloses a secondary ingredient storage chamber 26 and includes one or more jagged teeth 12*cc* along its base which are used to break through the foil seal 20 that covers the bottom of the ingredient storage chamber 24 formed by cylinder 12*d* when the dispensing cap is activated. Thus, the cap body 12 is a single molded device having a cylindrical wall 12*a* with threaded fasteners 12*aa*, an ingredient storage chamber 24 formed by cylinder 12*d*, and a dispensing activating member 12*c* movably attached to the cap body wall 12*a* by a flexible wall 12*b*. The activating member 12*c* could have its lower section divided into two separate semi cylindrical elements each forming almost half a cylinder in shape. This would allow the ingredients stored in the cap to escape easier and more completely.

Figure 4:
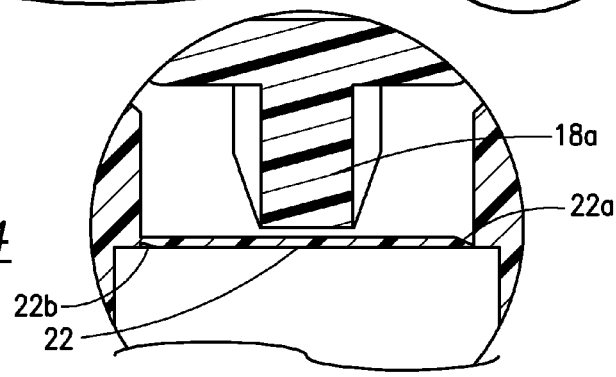
FIG. 4 shows a cutaway side elevational enlarged view of the element that unseals the drink passage.

The dispensing cap 12 also includes a drinking spout 18 that has a push-pull valve to allow a user to drink the mixed contents after the dispensing cap has been activated and to close the valve to prevent liquid from flowing out when not in use. The push-pull drinking spout 18 is also used to manually depress downwardly the activating member 12*c* causing the foil seal 20 to be ripped open. The drinking spout 18 also includes a seal piercing element 18*a*. When the drinking spout 18 is pushed downwardly, the piercing element 18*a* pierces the molded top seal barrier 22 which then allows the liquid contents in the primary container 16 to flow into the drinking spout 18. FIG. 4 shows an enlarged view of the drinking spout piercing element 18*a* positioned adjacent seal barrier 22 molded with activating member 12*c* as part of the molded dispensing cap. When the drinking spout piercing element 18*a* is pushed downwardly against seal barrier 22, the barrier 22 will tear apart along lines of weakening in the center area of the upper seal to prevent the seal barrier 22 from falling into the primary container 16. The upper seal barrier 22 can also be molded with peripheral lines of weakening 22*a* and 22*b*.

Figure 5:
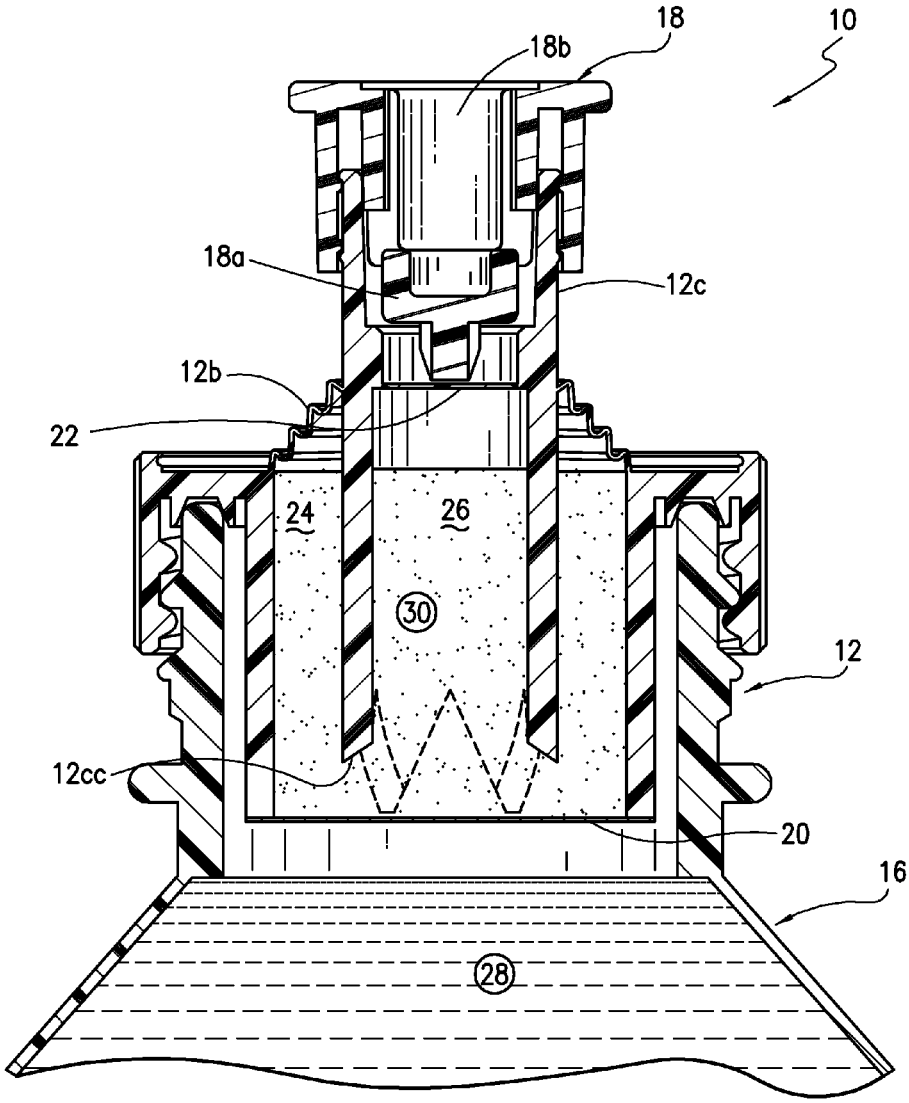
FIG. 5 shows a side elevational view in cross section with the dust cover removed before activation.

Referring now to FIG. 5, the primary container 16 is filled with a liquid 28 which is the contents of the primary container 16. The attached dispensing cap 12 has ingredients 30 located both in the storage chamber 24 and the secondary ingredient storage chamber 26. The ingredients 30 to be dispensed into the liquid contents 28 of container 16 can completely fill the storage compartments of dispensing cap 12. As shown in FIG. 5, the dust cover has been removed and the dispensing cap 12 is ready to be activated.

Figure 6:
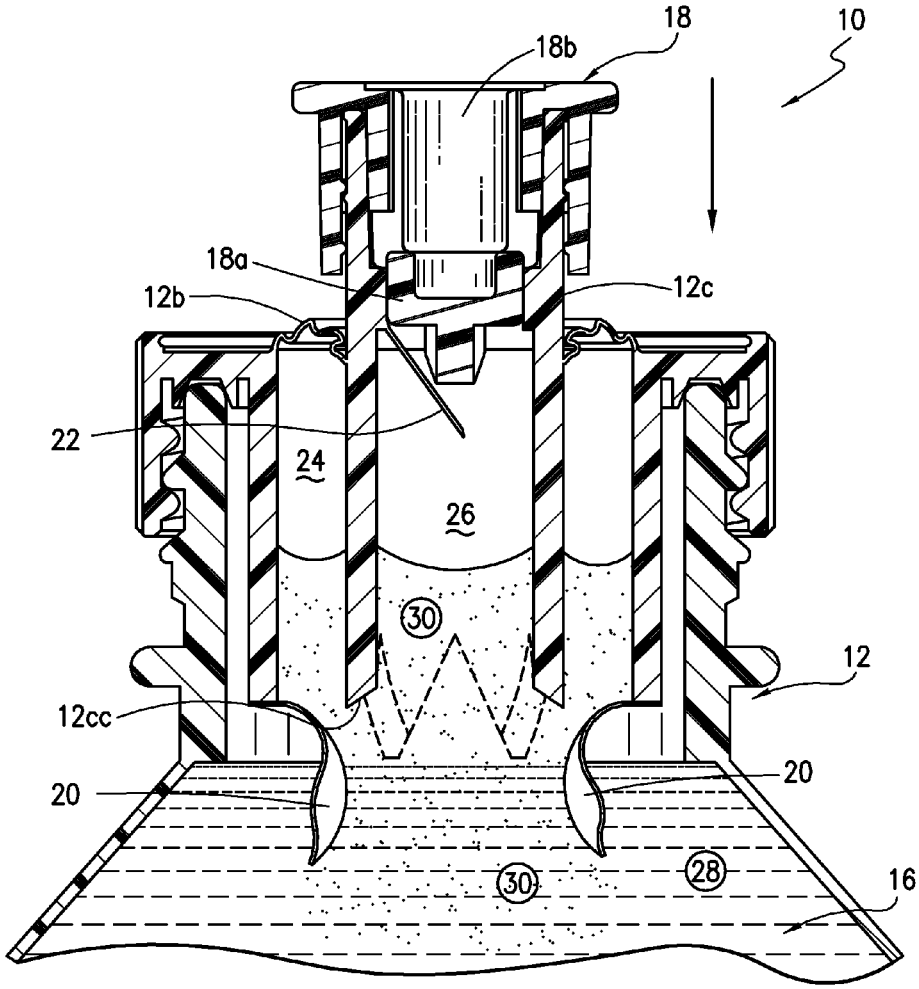
FIG. 6 shows a side elevational view of the invention in cross-section after the activating member has been depressed for releasing the ingredients in the cap storage chamber.

FIG. 6 shows the invention 10 and specifically the dispensing cap 12 fully activated. The drinking spout 18 has been manually depressed downwardly, forcing the cap body dispensing activating member 12*c* to move downwardly, allowing the teeth 12*cc* to engage and rip open foil seal 20. This allows the ingredients 30 to fall or be dispersed into the primary container 16 interior which has liquid contents 28 that now mixes with the ingredients 30 at the time of use. Also shown in FIG. 6 is that the upper seal barrier 22 has also been forced open and downwardly by the piercing element 18*a* due to the downward movement of the drinking spout 18 and stays attached to the liquid flow area and does not disengage and fall into the container. Once piercing this seal barrier 22, the user can now drink the contents that have been mixed in primary container 16 through the drinking spout 18 that includes a passageway 18*b*. The wall 12*b* connected to the dispensing activating member 12*c* is shown in the downward position. The bottom end of activating member 12*c* can be positioned to engage the ripped seal 20 segments to ensure the ingredients empty from the cap storage and the seal 20 segments do not rise up and block the passage once torn open.

As shown in FIG. 6, the drinking spout 18 also acts as a liquid flow valve 18*aa* to allow the liquid contents in primary container 16 to flow through passage 18*b* when the liquid flow valve 18*aa* is open and to not flow out of the primary container 16 when the push-pull drinking spout 18 is in the closed position as shown in FIG. 6.

Figure 14:
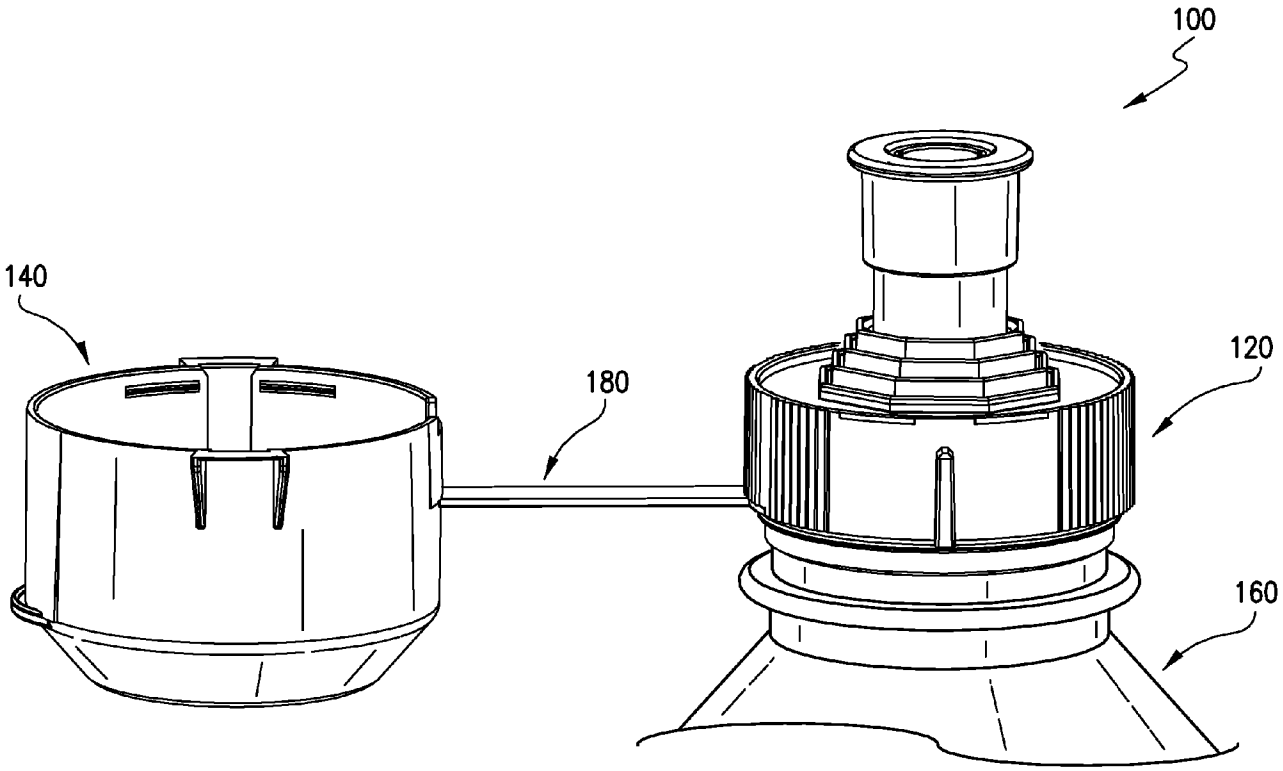
FIG. 14 shows a side elevational view of an alternative embodiment of the invention and in particular the dust cap used with the dispensing cap that can be manufactured as one piece or separate.

The dispensing cap 12 can be molded as a single piece as shown in FIG. 6 excluding the drinking spout 18 and in FIG. 14 without the drinking spout. The dispensing cap 12 also utilizes a drinking spout that can be manually activated with a push-pull action that allows the user to drink the contents directly from a primary container 16 and to close the valve so that the contents 28 and 30 cannot be spilled from primary container 16 when the device is not in use.

Figure 7:
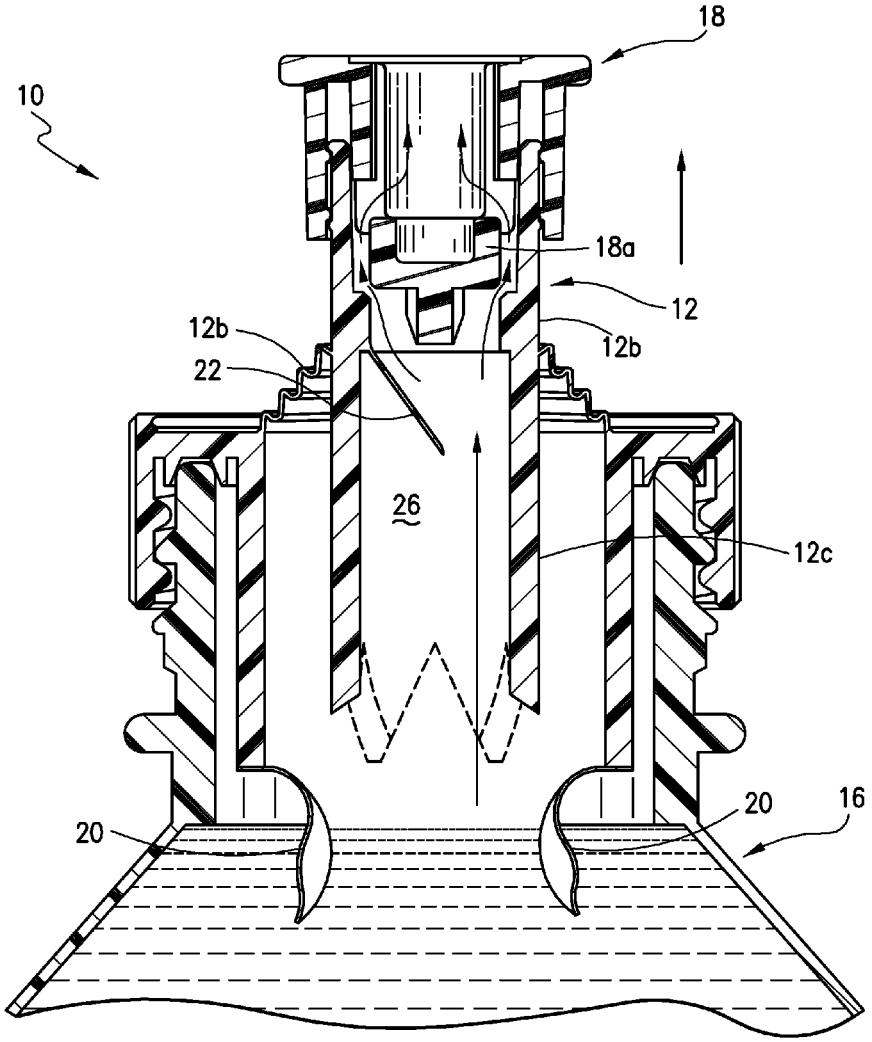
FIG. 7 shows a side elevational view in cross section after the dispensing has been activated.

Referring now to FIG. 7, the dispensing cap 12 is shown in a mode of operation after the ingredients have been activated and dispensed into primary container 16. Specifically, the drinking spout 18 which operates as a push-pull is shown in the full up position after activation which allows for a liquid (the contents of primary container 16) to flow through the internal passage of the activating member 12*c* namely through secondary ingredient storage chamber 26, past the liquid flow valve 18*aa* which includes the piercing element 18*a* and out through the spout 18. In the configuration shown in FIG. 7, the dispensing cap is in an activated mode for drinking the mixed contents at the time of use after the ingredients that were stored in the dispensing 12 have been dispensed into primary container 16 contents.

FIG. 8 shows an alternate embodiment of the invention wherein the bottom foil seal shown in FIG. 3 as foil seal 20 has been replaced by a cup-shaped molded plastic seal 32 which includes a bottom wall 32*a*. The cylindrical cup seal 32 is made of a liquid barrier such as plastic or other sealing material and is sized to snuggly fit around the outside surface of cylinder 12*d* so that the cylinder 12*d* is completely sealed (air and liquid) around its open bottom by the cup-shaped seal 32.

FIG. 9 shows an additional sealing tab 32*b* that is the top lip of the cup seal 32 shown in FIG. 8. The cap body 12*d* upper perimeter has a female tab shaped recess that receives tab 32*b* so that once the cup seal 32 has been inserted over cylinder 12*d* and the tab 32*b* inserted in place in the female recess along cylinder 12*d*, the cup seal 32 is firmly in place.

Referring now to FIG. 10, the inside surface of the cup seal 32 is shown having longitudinal ribs 32*c* protruding inwardly to allow air to escape when the cup seal 32 is snuggly fit over the cylinder 12*d* shown in FIG. 8. FIG. 10 also shows the cup seal 32 having a floor 32*a* which is a sealed barrier for liquid or dry ingredients until the floor is ruptured by the activating member 12*c*.

FIG. 11 is a top plan view of the cup seal 32. The cup seal floor 32*a* is shown. A hinge 32*aa* interrupts a line of weakening 32*bb* to prevent wall 32*a* from falling into container 16 after activation and can be attached at any location of the body of the cap.

Figure 12:
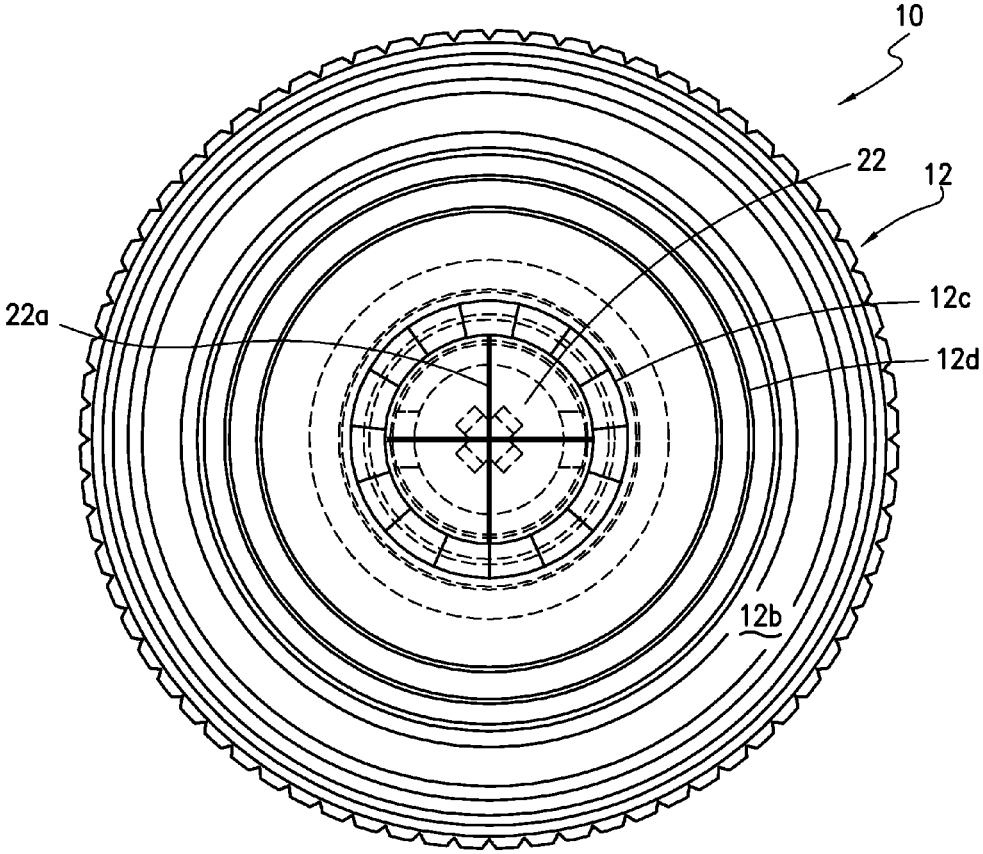
FIG. 12 shows a bottom plan view of the dispensing cap without the bottom seal over the storage chamber.

Referring now to FIG. 12*a* bottom plan view of the dispensing cap 12 is shown with the bottom foil seal removed. The activating member 12*c* is shown surrounding seal 22 which includes lines of weakening 22*a* in the center area of the seal. Also shown is the base of cylinder 12*d* which is part of the cap body. The activating member 12*c* that is shown is used to disperse the ingredients by tearing open the bottom foil seal (not shown).

Figure 13:
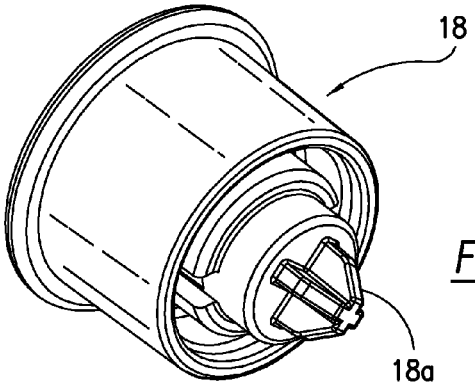
FIG. 13 shows a bottom perspective view of the drinking spout and piercing member used in the present invention.

FIG. 13 shows the drinking spout 18 in a bottom perspective view. Also shown as part of the drinking spout 18 is the push-pull piercing member 18*a* which is projecting from the bottom section of the push-pull drinking spout that allows flow through of liquids from a primary container through the drinking spout 18.

FIG. 14 shows a perspective view of an alternate embodiment of the invention that includes the invention 100 having a dust cover 140 tethered by band 160 to the dispensing cap 120, connected to the primary container 160 with the dust cover 140 removed from the top of the dispensing cap 120.

The instant invention has been shown and described herein in what is considered to be the most practical and preferred embodiment. It is recognized, however, that departures may be made there from within the scope of the invention and that obvious modifications will occur to a person skilled in the art.

What is claimed is:

1. A closure assembly for mixing ingredients with contents of a container to create a mixed beverage for dispensing, said closure assembly comprising:

a drinking spout comprising:

a first fluid passage;

a fluid valve having a piercing element;

a monolithic cap connected to said drinking spout, said cap comprising:

an ingredient storage chamber having a cylindrical sidewall extending between a top and a bottom;

an activating member having a second fluid passage, and an upper seal closing said second fluid passage and aligned with said piercing element of said drinking spout, said activating member at least partially disposed within said ingredient storage chamber and cooperating with said drinking spout to collectively form a push-pull assembly movable between an inactive pulled position and an active pushed position;

a resilient flexible annular wall extending between said activating member and said top of said ingredient storage chamber;

a lower seal closing said bottom of said ingredient storage chamber for retaining said ingredients; and, wherein a downward force on said drinking spout moving said push-pull assembly from said inactive pulled position to said active pushed position causes said piercing element to rupture said upper seal and said activating member to rupture said lower seal.

2. The closure assembly of claim 1, wherein when said push-pull assembly is configured in said inactive pulled position:

said ingredients are encapsulated and stored in said cap;

said upper and lower seals are intact, thereby preventing fluid communication between said first fluid passage and said second fluid passage.

3. The closure assembly of claim 1, wherein when said push-pull assembly is configured in said active pushed position:

said ingredients are released and mixed with said contents of said container, thereby creating said mixed beverage;

said upper and lower seals are ruptured, thereby enabling said fluid valve of said drinking spout to regulate fluid communication between said first fluid passage and said second fluid passage to selectively dispense said mixed beverage.

4. The closure assembly of claim 1, wherein said resilient flexible annular wall allows dynamic movement of said push-pull assembly while said cylindrical sidewall of said ingredient storage chamber remains static.

5. The closure assembly of claim 1, further comprising a dust cover removably connected to said cap to prevent accidental movement of said push-pull assembly.

6. A dispensing cap for mixing ingredients with contents of a container to create a drink, said dispensing cap comprising:

a foil liner;

a cap body molded as a single, integral, unitary piece, said cap body comprising:

a threaded outer skirt for engaging a threaded neck of said container;

an inner cylindrical sidewall having a lower distal end sealed by said foil liner to form an ingredient storage chamber;

an activating member having a lower fluid passage and a molded top seal closing said lower fluid passage, said activating member at least partially disposed within said ingredient storage chamber, said activating member movable between an inactive pulled position and an active pushed position;

a resilient flexible annular wall surrounding said activating member;

a drinking spout assembled upon said activating member of said cap body, said drinking spout comprising:

an upper fluid passage;

a fluid valve;

a piercing element disposed over said molded top seal;

wherein when said activating member is disposed in said inactive pulled position:

said foil liner and said molded top seal are intact, thereby preventing fluid communication between said lower fluid passage and said upper fluid passage; and, said ingredients are encapsulated and stored in said ingredient storage chamber; and, wherein when said activating member is disposed in said active pushed position:

said foil liner and said molded top seal are both pierced, thereby enabling said fluid valve of said drinking spout to regulate fluid communication between said lower fluid passage and said upper fluid passage; and, said ingredients are released and mixed with said contents of said container, creating said drink.

* * * * *